US007546960B2

(12) United States Patent
Stofner

(10) Patent No.: US 7,546,960 B2
(45) Date of Patent: Jun. 16, 2009

(54) SNOW MAKING APPARATUS AND METHOD FOR OPERATING THE SAME

(75) Inventor: Wilhelm Stofner, Freienfeld (IT)

(73) Assignee: Nivis GmbH-SRL (IT)

( * ) Notice: Subject to any disclaimer, the term of this patent is extended or adjusted under 35 U.S.C. 154(b) by 272 days.

(21) Appl. No.: 10/498,277

(22) PCT Filed: Dec. 10, 2002

(86) PCT No.: PCT/EP02/14013

§ 371 (c)(1),
(2), (4) Date: Jun. 3, 2004

(87) PCT Pub. No.: WO03/054460

PCT Pub. Date: Jul. 3, 2003

(65) Prior Publication Data

US 2005/0006493 A1 Jan. 13, 2005

(30) Foreign Application Priority Data

Dec. 11, 2001 (EP) ..... 01129558

(51) Int. Cl.
*F23D 11/40* (2006.01)
*F23D 14/62* (2006.01)
*F23D 11/16* (2006.01)
*F25C 3/04* (2006.01)

(52) U.S. Cl. ..... 239/419.5; 239/2.2; 239/14.2; 239/398; 239/418; 239/270

(58) Field of Classification Search ..... 239/2.1, 239/2.2, 8, 128, 14.1, 14.2, 426, 132.3, 270, 239/290, 291, 293, 296, 407, 418, 419.5, 239/425.5, 427.3
See application file for complete search history.

(56) References Cited

U.S. PATENT DOCUMENTS

| | | | | |
|---|---|---|---|---|
| 3,494,559 | A | 2/1970 | Skinner | |
| 3,716,190 | A * | 2/1973 | Lindlof | 239/2.2 |
| 3,945,567 | A | 3/1976 | Rambach | |
| 4,145,000 | A * | 3/1979 | Smith et al. | 239/14.2 |
| 4,353,504 | A | 10/1982 | Girardin et al. | |
| 4,383,646 | A * | 5/1983 | Smith | 239/14.2 |
| 4,593,854 | A | 6/1986 | Albertsson | |

(Continued)

FOREIGN PATENT DOCUMENTS

DE 3931398 A1 3/1991

(Continued)

OTHER PUBLICATIONS

Abstract of Japanese Patent Publication No. 03-140775, Pub. Date: Jun. 14, 1991, Patent Abstracts of Japan.

(Continued)

*Primary Examiner*—Len Tran
*Assistant Examiner*—James S Hogan
(74) *Attorney, Agent, or Firm*—Martine Penilla & Gencarella, LLP

(57) ABSTRACT

A snow making apparatus comprises at least one water/air nozzle for ejecting a water/air mixture. The snow making apparatus comprises at least one jet pump which operates with water as a driving medium and mixes air with the water and compresses the water/air mixture in order to form the water/air mixture which is supplied to the at least one water/air nozzle. A method of operating a snow making apparatus comprises corresponding features. The snow making apparatus and method enables unused energy to be used in a particularly effective manner.

22 Claims, 6 Drawing Sheets

U.S. PATENT DOCUMENTS

| | | | | | |
|---|---|---|---|---|---|
| 4,793,554 | A | * | 12/1988 | Kraus et al. | 239/2.2 |
| 4,836,446 | A | | 6/1989 | Chanel | |
| 5,090,619 | A | * | 2/1992 | Barthold et al. | 239/14.2 |
| 5,180,105 | A | * | 1/1993 | Teague | 239/14.2 |
| 5,379,937 | A | | 1/1995 | Rothe | |
| 6,378,778 | B1 | * | 4/2002 | Lurås | 239/14.2 |

FOREIGN PATENT DOCUMENTS

| | | | |
|---|---|---|---|
| DE | 4131857 | A1 | 4/1993 |
| DE | 4423124 | A1 | 1/1996 |
| DE | 19627586 | A1 | 7/1998 |
| IT | BZ990045 | | 4/2001 |
| JP | 03-140775 | | 6/1991 |
| JP | 06-002964 | | 1/1994 |
| JP | 2000-500220 | | 1/2000 |
| JP | 2002-502951 | | 1/2002 |
| WO | WO-94/19655 | A1 | 9/1994 |

OTHER PUBLICATIONS

Abstract of Japanese Patent Publication No. 07-177351, Pub. Date: Jul. 14, 1995, Patent Abstracts of Japan.

Abstract of International Publication No. WO 97/18421, Pub. Date: May 22, 1997.

Abstract of International Publication No. WO 99/40381, Pub. Date: Aug. 12, 1999.

* cited by examiner

SNOW MAKING APPARATUS AND METHOD FOR OPERATING THE SAME

BACKGROUND OF THE INVENTION

1. Field of the Invention

The invention relates to a snow making apparatus comprising at least one water/air nozzel which is adapted to eject a water/air mixture. The invention further relates to a method of operating a snow making apparatus.

2. Description of the Related Art

Snow making apparatuses (so-called "snow cannons") of various configurations are used in winter sports areas. DE 196 27 586 A1 gives an overview of known types of construction of snow making apparatuses. These include, in particular, high-pressure cannons close to the ground, high-pressure cannons of a lance type of construction (tower construction) and low-pressure cannons with a propeller.

High-pressure cannons close to the ground use compressed air to produce a water/air mist which is expelled at high speed in order to achieve the desired throwing range and active cooling due to rapid air expansion. Considerable quantities of compressed air are required. A central compressor is generally provided for a plurality of cannons, the compressor having a power rating of, for example, 15 to 20 kW.

With high-pressure cannons of lance form, the water/air nozzles are arranged at a height of 8 to 12 m above the piste. Lower expulsion rates may be employed, owing to the prolonged falling path. Therefore, the air compressor may have only, for a high-pressure cannon, a relatively low power rating of, for example, 5 kW per lance. A cannon of this design is shown in DE 196 27 586 A1.

With low-pressure cannons, a propeller produces a main air stream into which freezing nuclei are sprayed by means of nucleator nozzles and small water droplets are spayed by means of water nozzles. The nucleator nozzles are constructed as water/air nozzles. They are operated with compressed air and water under pressure and atomise a water/air mixture. The compressed air relaxes as it issues from the nucleator nozzles and thus cools water droplets of the water/air mixture to well below the freezing point so that small ice crystals are formed. The droplets discharged by the water nozzles settle on these freezing nuclei and thus form the snow crystal. With cannons of this design, compressed air which typically, as with the other designs mentioned, has to have a pressure of approximately 4 to 10 bar is required only for the nucleator nozzles. A compressed air power rating of about 4 to 5.5 kW is typically required. DE 41 31 857 A1 shows one such snow cannon with a screw compressor flanged on to the main motor.

With all the designs described hitherto, the snow making apparatus requires compressed air which has to be provided by a local or central compressor. This causes additional, considerable energy consumption. The compressor increases the production costs, requires maintenance and causes noise. In addition, proper working is not always ensured, in particular, at low temperatures. A compressor mounted on the snow making apparatus increases the weight thereof by about 120 kg, whereas a central compressor necessitates the laying of compressed air lines.

DE 44 23 124 A1 discloses a snow making apparatus of a propeller type of construction, which does not require an additional source of compressed air. The freezing nuclei are formed here by an auxiliary nozzle which is arranged in the main air stream. With this apparatus, which is dependent on the propeller type of construction, a propeller drive has to be provided that is dimensioned correspondingly more powerful.

SUMMARY

Broadly speaking, the present invention avoids the drawbacks described above by providing, in one embodiment, a snow making apparatus which does not require an air compressor or only requires an air compressor with a relatively low output. Advantages of the snow making apparatus will become apparent from the following detailed description, and may include, without limitation, efficient use of energy, which is wasted and converted into heat in snow making apparatuses according to the prior art; low production costs; light weight; high reliability, and requiring only minimal maintenance.

The present invention can be implemented in numerous ways, including as a process, an apparatus, a system, a device, or a method. Several embodiments of the present invention are described below.

In one embodiment, a snow making apparatus is provided. The snow making apparatus includes at least one water/air nozzle which is adapted to eject a water/air mixture. The snow making apparatus comprises at least one jet pump which operates with water as a driving medium, and mixes air with the water and compresses the water/air mixture in order to form the water/air mixture which is supplied to the at least one water/air nozzle.

In another embodiment, a method of operating a snow making apparatus is provided. The method includes producing a water/air mixture using at least one jet pump. The at least one jet pump operates with water as a driving fluid and the at least one jet pump compresses the air and mixes the air with the water. The method further includes ejecting the water/air mixture through at least one water/air nozzle.

In yet another embodiment, a method of operating a snow making apparatus is provided. The method includes producing a water/air mixture using at least one jet pump. The at least one jet pump operates with water as a driving fluid and the at least one jet pump mixes the air with the water and compresses the water/air mixture. The method further includes ejecting the water/air mixture through at least one water/air nozzle.

The invention embarks from the basic idea of using at least one jet pump (liquid jet gas compressor) for producing the water/air mixture expelled by at least one water/air nozzle. The jet pump operates without moving parts and is inexpensive, light and reliable. Ambient air or air which has been precompressed by a compressor is supplied to the jet pump, depending on the effective working pressure of the water available for the jet pump. In the first case, the air compressor which is usually required in the prior art is completely dispensed with; in the second case, the compressor may be correspondingly smaller and more cost-efficient in design.

The energy required to operate the jet pump is supplied to the snow making apparatus according to the invention via the operating pressure of the water supply. A surprising synergistic effect of the solution according to the invention is that energy which is wasted in prior art systems may be utilised on most snow making apparatuses in typical applications, namely for providing ski pistes with snow. This is because water is usually supplied to the snow making apparatuses arranged on a slope by a pump system located in the valley. The pump system supplies a pressure line which leads to the mountain and to which the snow making apparatuses are connected. The line pressure required for the snow making apparatus, for example 15 to 20 bar, must be available even at the highest point of the pressure line. Depending on the difference in height that the pressure line overcomes, the line pressure is much higher in the lower and middle region of the piste and is, for example, 40 to 80 bar or higher.

In systems according to the prior art, the connecting points of the pressure line comprise what are known as hydrants which correspondingly limit the operating pressure for the connected snow making apparatuses, in the manner of a throttle valve. The hydrants convert considerable amounts of energy into heat. For example, the throttle power is about 16 kW at a line pressure of 40 bar, an operating pressure of the snow making apparatus of 10 bar and a water consumption of 20 $m^3$/h. This energy, which remains unused in systems according to the prior art, may be utilised by the invention.

As already mentioned, ambient air or already pre-compressed air may be supplied to each jet pump. In some configurations of the invention, at least one multi-stage jet pump is used in order to obtain particularly high air compression. The jet pump (or at least one stage of the multi-stage jet pump) preferably comprises a driving nozzle for the water, a suction nozzle for the air, a mixing chamber for mixing the water issuing from the driving nozzle with the air flowing through the suction nozzle, and a diffuser for compressing the water/air mixture. A swirl member is provided in the suction nozzle in some configurations.

In particularly preferred embodiments, more than 50% or more than 75% or more than 90% or substantially all of the water throughput of the snow making apparatus passes through the jet pump or jet pumps and is expelled through the water/air nozzle or the water/air nozzles as a water/air mixture. In these configurations, the energy provided by the water is utilised particularly well. Preferably, more than 50% or more than 75% or more than 90% or substantially all of the nozzles of the snow making apparatus are configured as water/air nozzles (in contrast to mere water nozzles as in low-pressure cannons according to the prior art). A particularly large quantity of freezing nuclei is then produced.

To achieve particularly good compression of the water/air mixture, the effective working pressure of each jet pump, (i.e. the pressure difference which is available to the jet pump and is often also described as the effective driving fluid pressure) is preferably at least 10 bar or at least 20 bar or at least 30 bar. In preferred configurations, the snow making apparatus is preferably adapted for unthrottled or direct connection to a water pressure line having a line pressure of more than 20 bar or more than 30 bar or more than 40 bar.

In preferred configurations, the at least one jet pump comprises a nozzle needle for varying the water throughput and/or the mixing ratio of the expelled water/air mixture (and therefore the constitution of the snow produced). The nozzle needle may be adjusted by a motor or manually, taking into account, in particular, ambient parameters such as temperature, air humidity, etc. In some further developed configurations, the nozzle needle has an axial bore to increase the air throughput of the jet pump.

In further advantageous configurations of the invention, during operation of the snow making apparatus, different water/air nozzles or groups of water/air nozzles may simultaneously be supplied with water/air mixtures having different mixing ratios. This measure leads to snow having particularly good qualities. The water/air mixtures may be produced by jet pumps having different constructions or adjustments, or they may be derived from a single jet pump (for example at different points of the mixing chamber or diffuser).

To enable the water throughput to be adapted step-by-step to the requirements of snow production and environmental conditions, a plurality of water/air nozzles that may individually be turned on and/or a plurality of groups of water/air nozzles that may individually be turned on are provided in preferred configurations. These nozzles or nozzle groups may be connectable to an individual jet pump or to a group of jet pumps via a distributor. Preferably, however, at least one respective individual jet pump is provided for each nozzle or nozzle group that may individually be turned on.

The snow making apparatus according to the invention may be configured in any known type of construction. In particular, variants with a lance type of construction and as a propeller machine are provided. With the propeller type of construction, the snow making apparatus preferably comprises a motor-driven propeller for producing a main air stream, and the water/air nozzles are arranged in one or more nozzle rings so that they discharge the water/air mixture into the main air stream. With the lance type of construction, a vertical or oblique lance rod of which the end remote from the ground comprises a nozzle head with one or more water/air nozzles is provided in preferred configurations. The at least one jet pump may be arranged at the nozzle head or at the end of the lance rod close to the ground. The lance rod is preferably constructed as a pipe through which the water supply is conveyed in the first case and the water/air mixture is conveyed in the second case.

In preferred configurations, the method according to the invention is developed by features which correspond to the aforementioned features and/or the features mentioned in the dependent apparatus claims.

BRIEF DESCRIPTION OF THE DRAWINGS

Further features, advantages and objects of the invention will emerge from the following description of a plurality of embodiments and variants. Reference is made to the schematic drawings, in which.

DETAILED DESCRIPTION OF EXEMPLARY EMBODIMENTS

Figure 1:
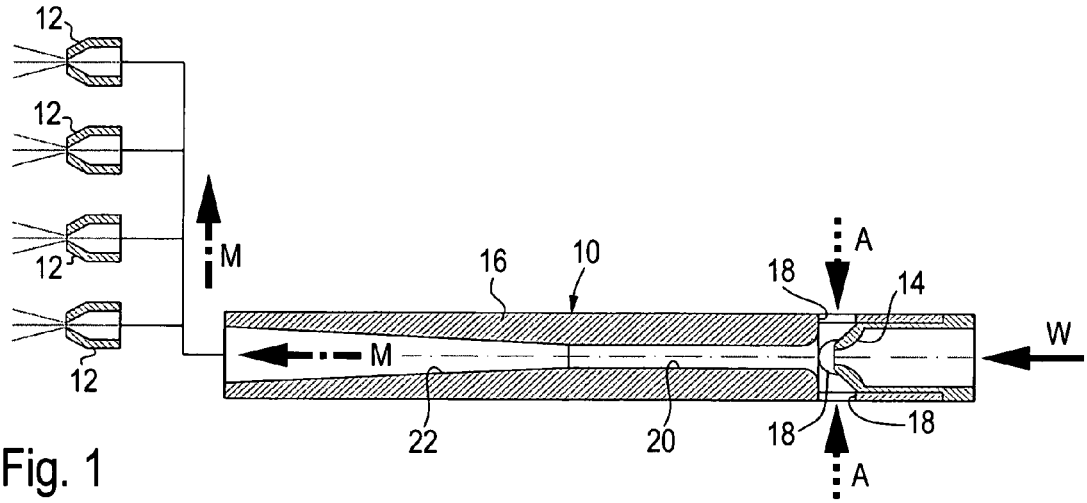
FIG. 1 is a basic sketch of an embodiment according to the invention.

The basic sketch in FIG. 1 shows certain elements of a snow making apparatus according to one embodiment comprising a jet pump 10 and a plurality of water/air nozzles 12. The jet pump 10 is formed in a manner known per se with a driving nozzle 14 and a pump tube 16, the pump tube 16 comprising suction nozzles 18, a mixing chamber 20 and diffuser 22. In the embodiment described here, the driving nozzle 14 comprises a circular nozzle opening having a diameter of, for example, 4 mm or 5 mm. In the present example, the suction nozzles 18 are configured as bores with a diameter of 12 mm in the pump tube 16, and the mixing chamber 20 here is a mixing tube with a constant cross-section. In some embodiments of the jet pump 10, a swirl member (not shown) is arranged in the driving nozzle 14.

During operation of the snow making apparatus, water W is supplied to the jet pump 10 via a pressure line (not shown) at a pressure of about 25 to 40 bar or higher. The water W serves as a driving medium here; the path of the driving water stream is designated by a continuous arrow in FIG. 1. The water W issues from the driving nozzle 14 as a high speed jet and entrains air A which enters the pump tube 16 through the suction nozzles 18 (the entry direction of the air A is illustrated by dotted arrows in FIG. 1). The speeds of the water W and the air A become the same in the mixing chamber 20, and the two media mix intensively. The high speed of the resultant water/air mixture M is partially converted into pressure again in the diffuser 22.

The water/air mixture M now passes to the water/air nozzles 12 through which it is expelled (the flow path of the mixture M is indicated by the dot-dash arrows in FIG. 1). The air expands abruptly as it leaves the water/air nozzles 12 and cools the finest water droplets to well below the freezing point. At suitably low ambient temperatures, further droplets of the water/air mixture M settle on these freezing nuclei and form snow crystals.

Figure 2:
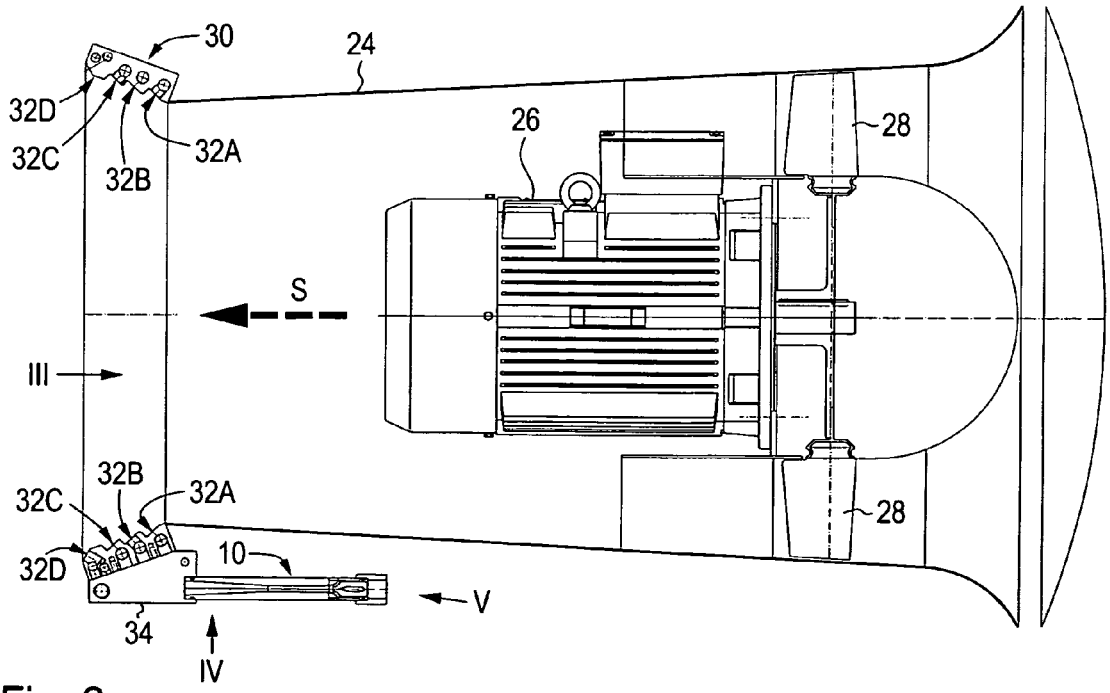
FIG. 2 is a side view of a first embodiment of the invention in the form of a propeller machine.

The snow making apparatus shown in FIG. 2 has a main tube 24 in which there is arranged an electric motor 26 with a flange-mounted propeller 28. During operation, the propeller 28 driven by the electric motor 26 with a power rating of approximately 5 to 15 kW produces a main stream S of which the direction is indicated in FIG. 2 by a dashed arrow. The main tube 28 tapers in the flow direction to a diameter of about 56 cm.

A nozzle module 30 connected to the outlet side of the main tube 24 contains a number of water/air nozzles 12 (FIG. 1), which are arranged in a plurality of nozzle rings 32A, 32B, 32C, 32D. A distributor 34 is connected, on the one hand, to the nozzle module 30 and, on the other hand, to a plurality of jet pumps 10, only one of which is visible in FIG. 2. In the present embodiment, the snow making apparatus comprises only water/air nozzles 12 which are supplied with the water/air mixture M produced by the jet pumps 10. Water-only nozzles are not provided.

Figure 3:
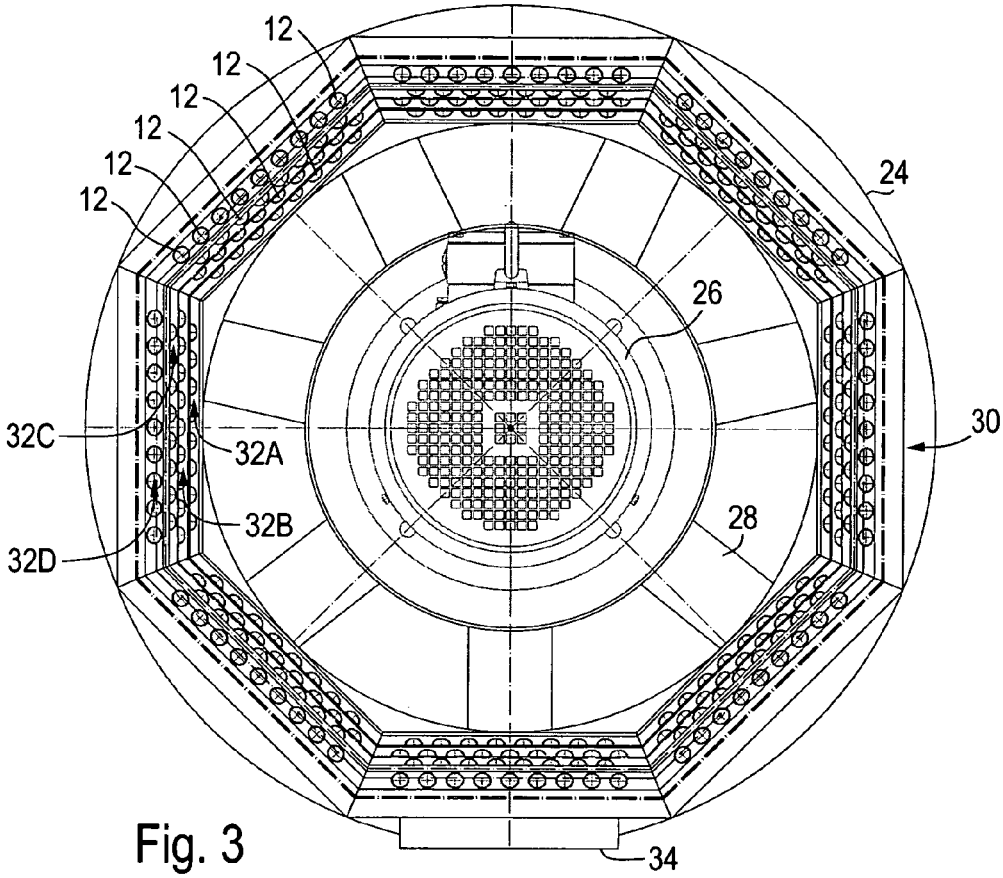
FIG. 3 is a front view of the propeller machine of FIG. 2 in the direction of the arrow III.

The front view in FIG. 3 shows, in particular, the concentric arrangement of the four nozzle rings 32A, 32B, 32C, 32D. In the present example, each of the nozzle rings 32A, 32B, 32C, 32D is configured as an octagon with 64 or 72 water/air nozzles 12. A circumferential channel of each nozzle ring 32A, 32B, 32C, 32D is connected to the distributor 34.

Figure 4:
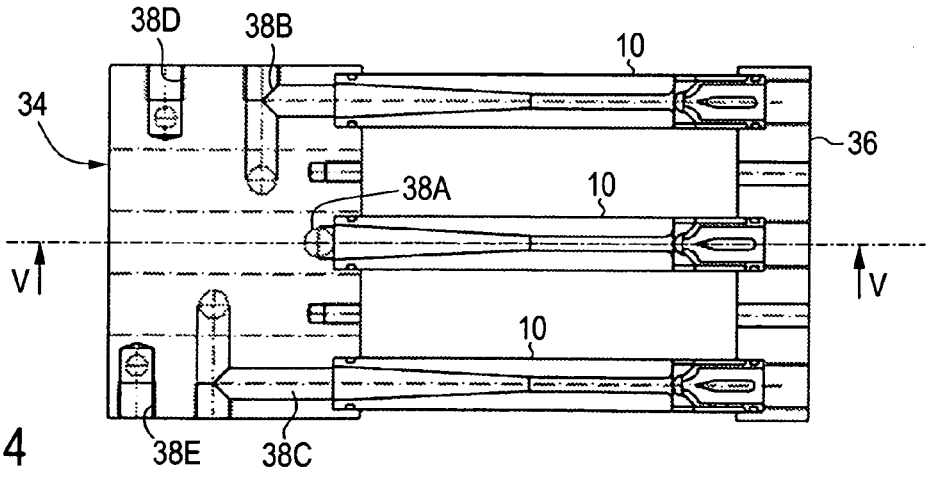
FIG. 4 is an enlarged bottom view in the direction of the arrow IV of the pump module shown from the side in FIG. 2.

The enlarged view of the pump module in FIG. 4 shows the distributor 34 and three jet pumps 10 which are connected to the compressed water supply via a connecting piece 36. Each jet pump 10 supplies a respective nozzle ring 32A, 32B, 32C with the water/air mixture M via an associated connecting duct 38A, 38B, 38C. The nozzle ring 32D is connected to a further jet pump 10 (not shown in FIG. 4) via two further connecting ducts 38D, 38E.

Whereas all jet pumps 10 are always operated in the embodiment of FIG. 4, valves are provided in variations, which valves may be arranged on the inlet side in the connecting piece 36 or on the outlet side in the distributor 34. The nozzle rings 32A, 32B, 32C, 32D may be turned on and off individually by suitably controlling these valves, so that it is possible that one or more or all nozzle rings 32A, 32B, 32C, 32D are active in each case. In this configuration, the water throughput and therefore the snow production level may be regulated in a cost-effective manner.

Figure 5:
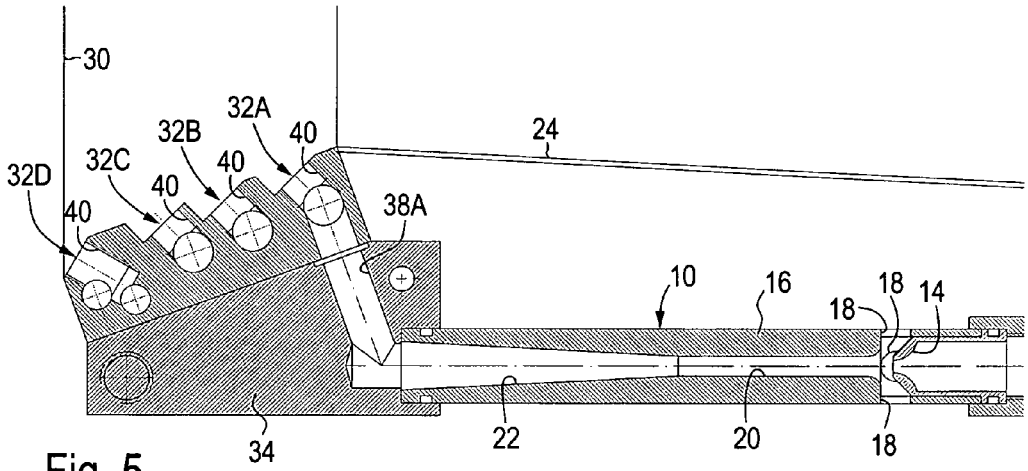
FIG. 5 is an enlarged section of the region V of FIG. 2 along the line V-V in FIG. 4.

FIG. 5 shows, by way of example, a section through the nozzle module 30 which extends through a respective nozzle bore 40 of the four nozzle rings 32A, 32B, 32C, 32D. The nozzle bores 40 are provided for receiving the water/air nozzles 12, for example in the construction shown in FIG. 1. Suitable water/air nozzles 12 are commercially available as inserts for the nozzle bores 40 and, as such, do not form the subject of the present invention.

Figure 6:
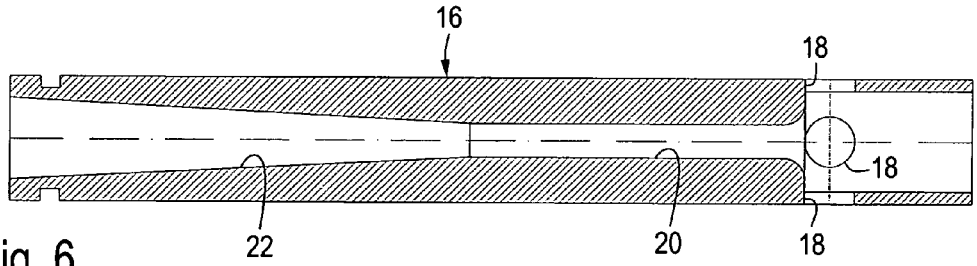
FIG. 6 is a further enlarged section of the pump tube shown in FIG. 5.

The pump tube 16 is shown on an enlarged scale in FIG. 6. The pump nozzles 18 are arranged as four bores offset radially by 90° each in the inlet-side portion of the pump tube 16.

Figure 7:
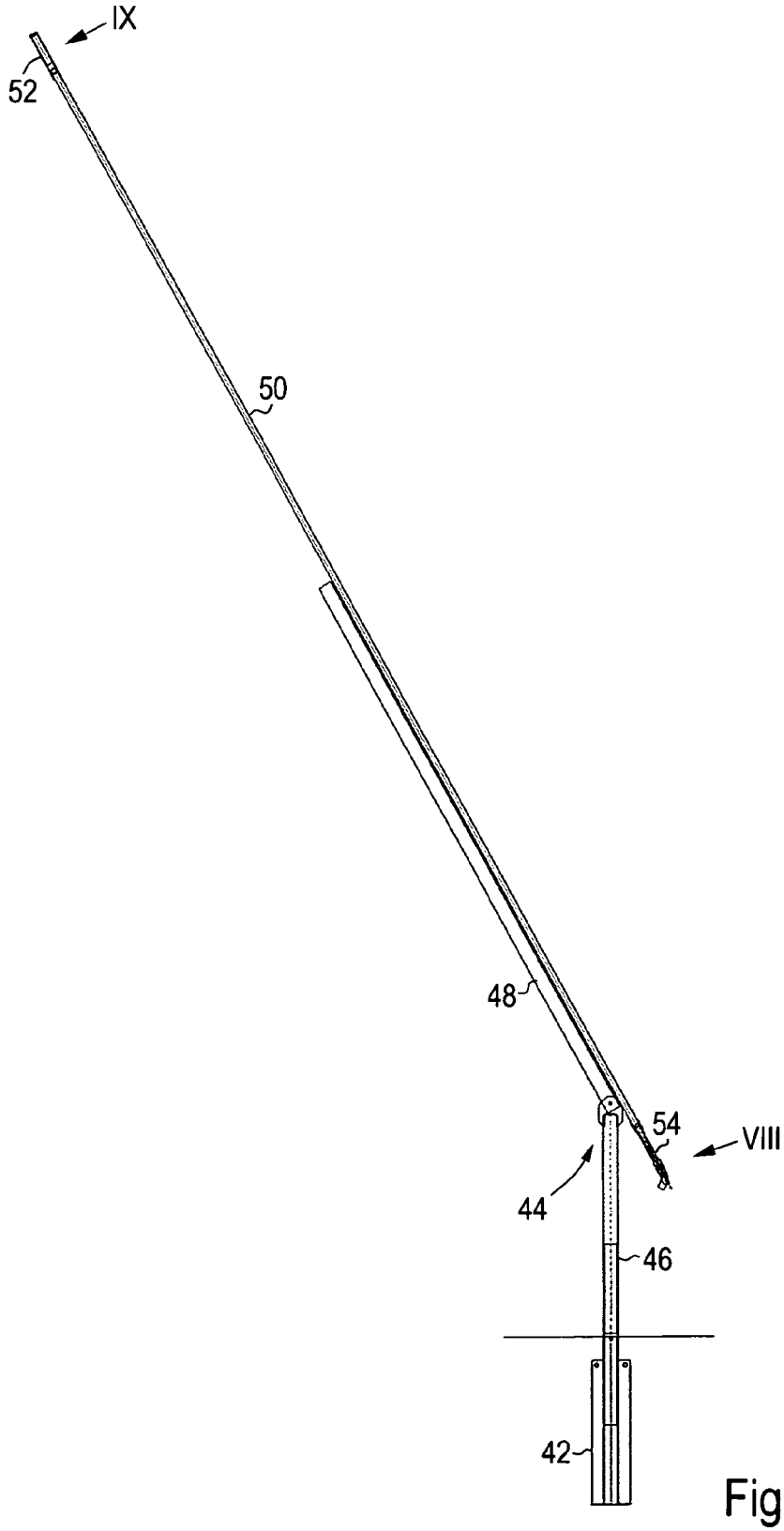
FIG. 7 is a side view of a second embodiment of the invention of lance type of construction.

In the embodiment of FIG. 7, the snow making apparatus is configured as a lance type of construction. An anchor 42 located in the ground fixes a holder 44 comprising two hingedly connected support rods 46, 48. The snow making apparatus in the stricter sense is fastened on the upper support rod 48. It has a lance rod 50 which is, for example, 8 to 12 m long, is formed as a pipe, and at the upper end of which there is arranged a nozzle head 52 and at the lower end of which there is arranged a pump element 54.

Figure 8:
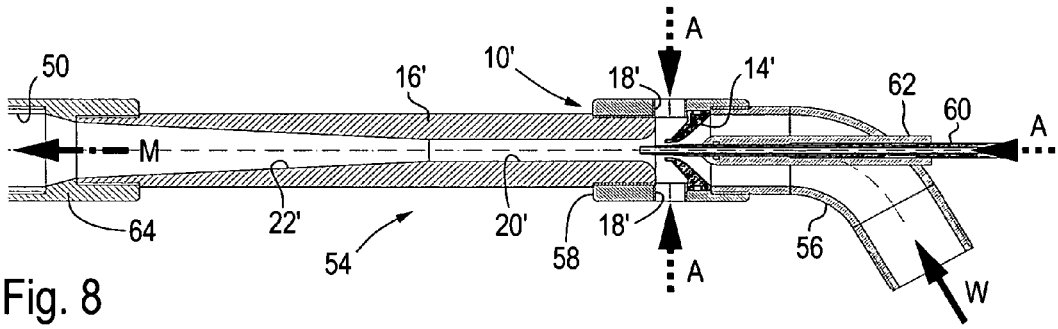
FIG. 8 is an enlarged side view of the region VIII of FIG. 7 in a section along the longitudinal axis.

As shown in FIG. 8, the pump element 54 comprises a jet pump 10' and a connecting elbow 56 connected thereto. The compressed water W required for operation is supplied to the jet pump 10' via the connecting elbow 56. Similarly to the jet pump 10 in FIG. 1, the jet pump 10' is configured with a driving nozzle 14' and a pump tube 16' with a mixing chamber 20' and diffuser 22'. A connecting piece 58 comprises bores for admitting ambient air A which act as suction nozzles 18'. The connecting piece 58 connects the connecting elbow 56, the driving nozzle 14' and the pump tube 16' to a module. On the outlet side, the jet pump 10' is connected via a sleeve 64 to the pipe-shaped lance rod 50.

The jet pump 10' further comprises a nozzle needle 60 which comprises a through-bore and is supported in a longitudinally displaceable manner in a guide 62. The pump properties of the jet pump 10' can be adapted to the requirements by appropriate adjustment of the nozzle needle 60; in particular, it is possible to vary the water throughput and/or the mixing ratio of water and air in the water/air mixture M. Adjustment can be carried out manually (for example during installation or maintenance of the system) or automatically (for example depending on the desired quantity of snow or weather conditions). In the present example, the nozzle needle 60 has a through-bore along its longitudinal axis, so further ambient air A can be introduced into the driving jet of the jet pump 10' in order to increase the pump capacity. However, variations comprising a nozzle needle 60 which does not have a through-bore are also provided and still have the advantage of improved adjustability.

Figure 9:
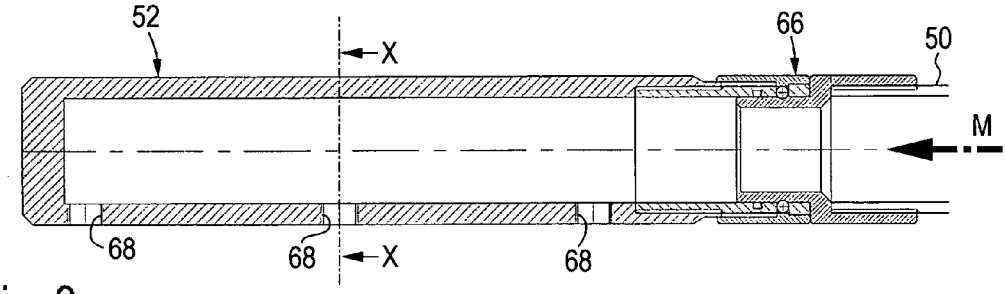
FIG. 9 is an enlarged side view of the region XI of FIG. 7 in a section along the longitudinal axis.
Figure 10:
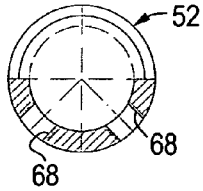
FIG. 10 is a cross-section through the nozzle head shown in FIG. 9, along the line X-X.
Figure 15:
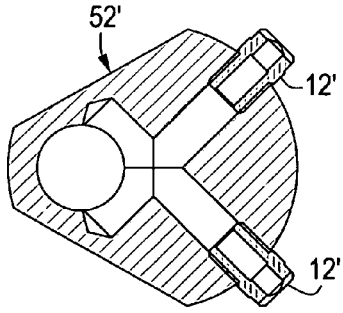
FIG. 15 is a transverse section along the line XV-XV in FIG. 13.
Figure 16:
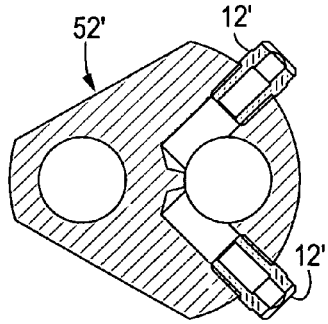
FIG. 16 is a transverse section along the line XVI-XVI in FIG. 13.
Figure 11:
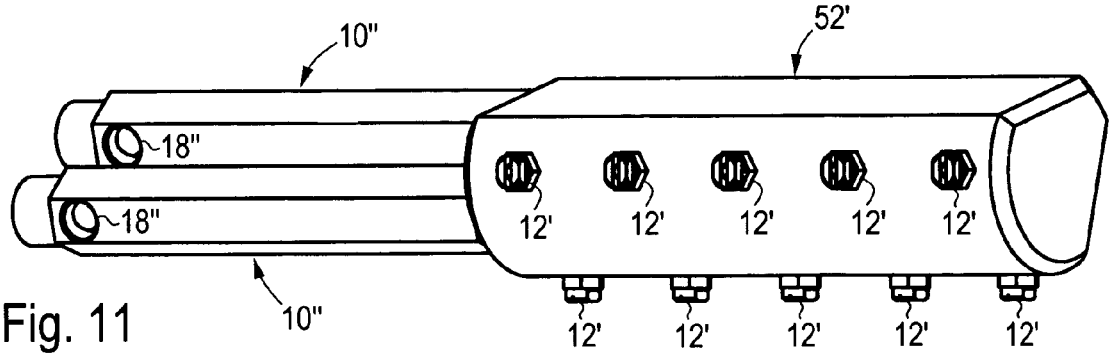
FIG. 11 is a perspective oblique top view of a nozzle head and jet pumps according to a further embodiment of the invention.
Figure 12:
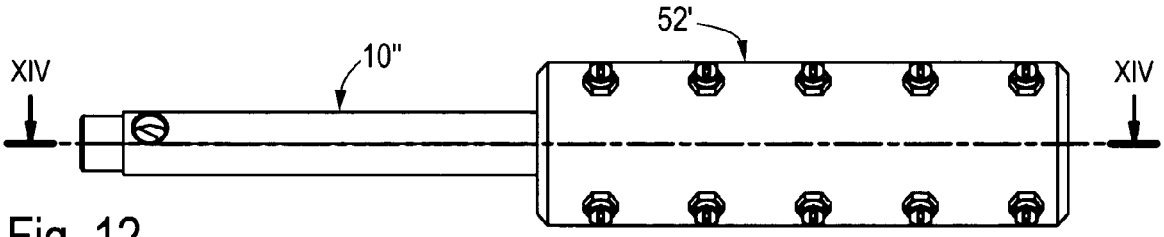
FIG. 12 is a front view of the nozzle head according to FIG. 11.
Figure 13:
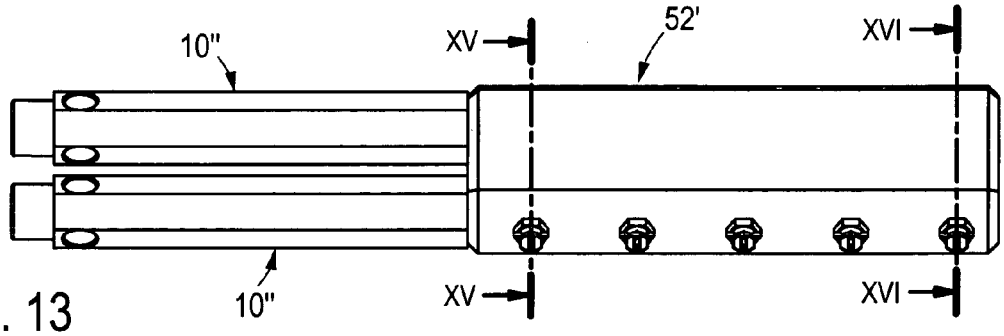
FIG. 13 is a top view of the nozzle head according to FIG. 11.
Figure 14:
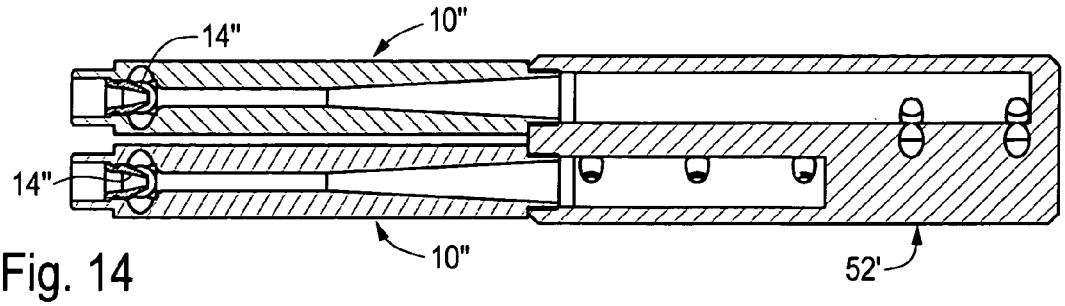
FIG. 14 is a longitudinal section along the line XIV-XIV in FIG. 12.

The nozzle head 52 shown in detail in FIG. 9 is detachably connected to the upper end of the lance rod 50 (FIG. 7) by a connecting and sealing module 66. As shown in FIG. 9 and the cross-section of FIG. 10, the nozzle head 52 in the present example has a total of six bores 68, each for receiving a respective water/air nozzle 12 (FIG. 1) in the form of a nozzle insert known per se.

During operation, the water/air mixture M produced by the jet pump 10' is fed into the lance rod 50 and from there into the nozzle head 52. The water/air mixture M issues from the water/air nozzles 12 (FIG. 1) as a fine spray mist. Expansion leads to freezing nuclei from which snow crystals are created by the deposition of further water droplets during the relatively long falling path to the ground. In the configuration described here, the pipe-shaped lance rod 50 serves to convey the water/air mixture M from the jet pump 10' to the nozzle head 52. Further lines, whether for compressed air or for water, are not required. It is merely necessary to establish a connection between the connecting elbow 56 and a water pressure line which is already laid next to the piste in existing piste installations.

In further variations, jet pumps 10' as shown in FIG. 8 are also used in the propeller machine according to FIG. 2, in order to also obtain the possibilities for adjustment afforded by the nozzle needle 60. Conversely, the snow making apparatuses in lance form according to FIG. 7 may also be equipped with the simpler jet pumps 10 according to FIG. 1.

FIG. 11 to FIG. 16 show, as a further embodiment of the invention, a nozzle head 52' which forms a compact module together with two jet pumps 10". The module is intended to be mounted on the towering end of a lance rod, at a height of, for example, 10 m. In other words, the present embodiment represents a modification of the embodiment of FIG. 7 in that the nozzle head 52 in FIG. 7 has now been replaced by the nozzle head 52' and in that the pump element 54 in the form of the jet pumps 10" has been mounted directly on the nozzle head 52'. Owing to the constructional combination of the jet pumps 10" with the nozzle head 52', separation of the water/air mixture M—which might possibly occur in the lance rod 50 with the embodiment of FIG. 7—is avoided.

Referring to FIG. 11 to FIG. 16, the jet pumps 10" according to the present embodiment each comprise a driving nozzle 14" and a plurality of suction nozzles 18". The nozzle head 52' is provided with a total of ten screw-in water/air nozzles 12' of which the four shown on the right of FIG. 11 to FIG. 14 form a first group and the six shown in the middle of FIG. 11 to FIG. 14 form a second group. The driving nozzles 14" of the two jet pumps 10" have different diameters, and therefore different water throughputs. The jet pump 10" with the smaller driving nozzle diameter supplies the first group of the four water/air nozzles 12', and the jet pump 10" with the greater driving nozzle diameter supplies the second group of the six water/air nozzles 12'. In total, therefore, three-stage water regulation is achieved by activating either only the first group of driving nozzles 14" or only the second group of driving nozzles 14" or both groups of driving nozzles.

Flat nozzles are used as water/air nozzles 12' in the present embodiment, to achieve the fastest possible relaxation of the air and therefore to cool the smallest water droplets which then freeze and therefore form the freezing nuclei for the remaining water.

A further advantage of the configuration according to FIG. 11 to FIG. 16 over that of FIG. 7 resides in the better utilisation of energy. As the jet pumps 10" preferably operate with a pressure ratio of approximately 3:1, the pressure drop of about 1 bar in the lance pipe 50 which towers upwardly by about 10 m has to be compensated by a pressure which is about 3 bar higher at the driving nozzle 14' of the jet pump 10' in the embodiment of FIG. 7. With the embodiment of FIG. 11 to FIG. 16, on the other hand, an additional water pressure of only about 1 bar is required to achieve the desired driving nozzle pressure.

A large number of further modifications, in particular with respect to the dimensioning of the individual components and/or the number or configuration of the jet pumps 10, 10', 10" or of the water/air nozzles 12, 12' is immediately apparent to the person skilled in the art.

The invention claimed is:

1. A snow making apparatus, comprising at least one water/air nozzle which is adapted to eject a water/air mixture, wherein the snow making apparatus comprises at least one jet pump which operates with water as the primary driving medium and air as the primary driven medium, and which mixes the air with the water and compresses the water/air mixture in order to form the water/air mixture which is supplied to the at least one water/air nozzle, wherein the air is drawn in by the at least one jet pump and is essentially uncompressed ambient air, and wherein at least one of the at least one jet pump comprises at least one driving nozzle for the water, at least one suction nozzle for the air, a mixing chamber for mixing the water issuing from the at least one driving nozzle with the air flowing through the at least one suction nozzle, and a diffuser for compressing the water/air mixture.

2. The snow making apparatus according to claim 1, wherein more than 50% of the total water throughput of the snow making apparatus passes through the at least one jet pump and is ejected from the at least one water/air nozzle.

3. The snow making apparatus according to claim 1, wherein the snow making apparatus is adapted for an unthrottled connection to a water line with a line pressure of more than 20 bar, and wherein the effective working pressure of the at least one jet pump is at least 10 bar.

4. The snow making apparatus according to claim 1, wherein the at least one jet pump has a nozzle needle for changing the water throughput.

5. The snow making apparatus according to claim 1, wherein the at least one jet pump has a nozzle needle for changing the mixing ratio of the water/air mixture.

6. The snow making apparatus according to claim 1, wherein a plurality of water/air nozzles are provided, and wherein the snow making apparatus is adapted to supply the plurality of water/air nozzles simultaneously with water/air mixtures having different mixing ratios.

7. The snow making apparatus according to claim 1, wherein a plurality of groups of water/air nozzles are provided, and wherein the snow making apparatus is adapted to supply the plurality of groups of water/air nozzles simultaneously with water/air mixtures having different mixing ratios.

8. The snow making apparatus according to claim 1, wherein a plurality of water/air nozzles that may be turned on individually are provided for adjusting the water throughput.

9. The snow making apparatus according to claim 8, wherein at least one respective jet pump is provided for each water/air nozzle that may be turned on individually.

10. The snow making apparatus according to claim 1, wherein a plurality of groups of water/air nozzles that may be turned on individually are provided for adjusting the water throughput.

11. The snow making apparatus according to claim 10, wherein at least one respective jet pump is provided for each group of water/air nozzles that may be turned on individually.

12. The snow making apparatus according claim 1, wherein the snow making apparatus comprises a motor-driven propeller for producing a main air stream, and wherein the water/air nozzles are arranged in one or more nozzle rings so as to discharge the water/air mixture into the main air stream.

13. The snow making apparatus according to claim 1, wherein the snow making apparatus comprises a lance rod at one end of which there is arranged the at least one jet pump and at the other end of which there is arranged a nozzle head with the at least one water/air nozzle.

14. The snow making apparatus according to claim 1, wherein the snow making apparatus comprises a lance rod at one end of which there is arranged a module with the at least one jet pump and a nozzle head with the at least one water/air nozzle.

15. method of operating a snow making apparatus, comprising:

producing a water/air mixture using at least one jet pump which operates with water as the primary driving fluid and air as the primary driven fluid, and which compresses the air and mixes the air with the water, wherein the air drawn in by the at least one jet pump is essentially uncompressed ambient air, and wherein at least one of the at least one jet pump comprises at least one driving nozzle for the water, at least one suction nozzle for the air, a mixing chamber for mixing the water issuing from the at least one driving nozzle with the air flowing through the at least one suction nozzle, and a diffuser for compressing the water/air mixture; and ejecting the water/air mixture through at least one water/air nozzle.

16. A method of operating a snow making apparatus, comprising:

producing a water/air mixture using at least one jet pump which operates with water as the primary driving fluid and air as the primary driven fluid, and which mixes the air with the water and compresses the water/air mixture, wherein the air drawn in by the at least one jet pump is essentially uncompressed ambient air, and wherein at least one of the at least one jet pump comprises at least one driving nozzle for the water, at least one suction nozzle for the air, a mixing chamber for mixing the water issuing from the at least one driving nozzle with the air flowing through the at least one suction nozzle, and a diffuser for compressing the water/air mixture; and ejecting the water/air mixture through at least one water/air nozzle.

17. The method according to claim 16, wherein more than 50% of the total water throughput of the snow making apparatus passes through the at least one jet pump and is ejected from the at least one water/air nozzle.

18. The method according to claim 16, wherein the snow making apparatus is adapted for an unthrottled connection to a water line with a line pressure of more than 20 bar, and wherein the effective working pressure of the at least one jet pump is at least 10 bar.

19. The method according to claim 16, wherein a plurality of water/air nozzles that may be turned on individually are provided for adjusting the water throughput.

20. The method according to claim 19, wherein at least one respective jet pump is provided for each water/air nozzle that may be turned on individually.

21. The method according to claim 16, wherein a plurality of groups of water/air nozzles that may be turned on individually are provided for adjusting the water throughput.

22. The method according to claim 21, wherein at least one respective jet pump is provided for each group of water/air nozzles that may be turned on individually.

* * * * *